US006940052B2

(12) United States Patent
Block et al.

(10) Patent No.: US 6,940,052 B2
(45) Date of Patent: Sep. 6, 2005

(54) FUSE MECHANISM FOR A HEATING DEVICE AND HEATING DEVICE

(75) Inventors: Volker Block, Bretten (DE); Juergen De Marco, Oberderdingen (DE)

(73) Assignee: E.G.O. Elektro-Geraetebau GmbH (DE)

( * ) Notice: Subject to any disclaimer, the term of this patent is extended or adjusted under 35 U.S.C. 154(b) by 0 days.

(21) Appl. No.: 10/680,270

(22) Filed: Oct. 7, 2003

(65) Prior Publication Data

US 2004/0069763 A1 Apr. 15, 2004

(30) Foreign Application Priority Data

Oct. 9, 2002 (DE) ..... 102 48 066

(51) Int. Cl.[7] ..... H05B 1/02; H01H 71/10
(52) U.S. Cl. ..... 219/517; 337/171
(58) Field of Search ..... 219/517, 221, 219/505, 541; 337/182–183, 171, 176

(56) References Cited

U.S. PATENT DOCUMENTS 530,430 A * 12/1894 Klein ..... 337/403
839,255 A * 12/1906 Ayer ..... 219/517
854,396 A * 5/1907 Ayer ..... 219/517
1,804,885 A * 5/1931 McCartney ..... 219/200
2,626,340 A * 1/1953 Huck ..... 219/517
3,423,567 A * 1/1969 Mills ..... 219/212
4,494,104 A 1/1985 Holmes
5,084,691 A 1/1992 Lester et al.
5,652,562 A 7/1997 Riley
6,445,276 B2 * 9/2002 Schon et al. ..... 337/184

FOREIGN PATENT DOCUMENTS

GB 2205455 * 12/1988
JP 11-353993 12/1999
JP 2000-113783 4/2000

* cited by examiner

*Primary Examiner*—John A. Jeffery
(74) *Attorney, Agent, or Firm*—Akerman Senterfitt

(57) ABSTRACT

A fuse mechanism for a heating device according to the invention functions as a thermal fuse. A heater is located on a support. In spatial proximity and with heat conduction to the heater are provided solder contacts with electrical leads to the support. A metallic connection bridge is firmly soldered to the solder contacts and the position thereof with respect to said contacts is such that in the use state on softening the solder connection at the solder contacts the connection bridge is separated by gravity and drops off. In this way the electrical connection from the heater to a electrical supply is separated.

20 Claims, 1 Drawing Sheet

FUSE MECHANISM FOR A HEATING DEVICE AND HEATING DEVICE

FIELD OF APPLICATION AND PRIOR ART

The invention relates to a fuse mechanism for a heating device and to a heating device with such a fuse mechanism.

It is known to provide certain heating devices, e.g. for water heaters, with a thermal safety fuse. The latter is intended to ensure that in the case of overheating there is no damage or even worse, e.g. a fire. Such safety fuses are in heat conducting contact with the heating device. A heat-releasing or electrical contact, e.g. in the form of a retracting tin solder track, is provided as the actual fuse mechanism.

It is also possible to use bimetallic switches enabling a reversible overload protection to be obtained.

A problem with known safety fuses is that high technical and assembly expenditure is required for implementing fuse protection, so that if there is no temperature drop in the case of high thermal rise rates of heating elements, particularly low-weight thick film heating elements protection is obtained. Such a non-existing temperature drop can e.g. be the running dry of a water boiler. In the most serious case the heating device or basic insulation can be destroyed.

PROBLEM AND SOLUTION

The problem of the present invention is to provide a fuse mechanism for a heating device, as well as a heating device provided therewith enabling the prior art problems to be avoided, whilst in particular providing a very rapidly reacting fuse mechanism for thermal protection of a heating device.

This problem is solved by a fuse mechanism far a heating device, and by a healing device having a support and a heating element, in which the heating element is provided with two contacts and electrically conductive connection bridge connects the heating device to a power supply. The connection bridge is mechanically fastened in electrically conductive manner to both of the contacts by fastening means and the mechanical fastening of the fastening means is released above a certain melting temperature. The thermal fuse mechanism is positioned on the heating device in such a way that the fastening means are in heat conducting connection with the heating device. The connection bridge is secured by the mechanical fastening to the contacts by means of the fastening means against moving away due to gravity. The fuse mechanism is positioned on the heating device in such a way that the fastening means are in heat conducting connection with the heating device.

According to the invention, the fuse mechanism has two contacts and a connection bridge, the latter being electrically conductive and forming a connection of the heating device to a current or power supply. The connection bridge is mechanically and electroconductively fixed to both contacts. For this purpose fixing or fastening means are provided, whose fastening or fastening action is discontinued above or on exceeding a given temperature.

The fuse mechanism is located on the heating device in such a way that the fastening means and/or the connection bridge are in heat conducting connection with the heating device. According to the invention, the connection bridge is held by the fastening means on the contacts in such a way that a moving away as a result of gravity is prevented. This means that the connection bridge is only secured on the contacts by fastening with the fastening means. If one or both fastenings are detached, the connection bridge moves away from the contacts or drops off the same. As a result there is no need to provide a separate force, e.g. spring tension. Use is made of the gravity which is in any case present and which also acts on such a connection bridge.

With particular advantage such a fuse mechanism can be used for a heating device installed by so-called "head first fitting". This means that the fuse mechanism is located below the device and as a result of this arrangement the connection bridge can be released or dropped without difficulty from the contacts and therefore also the heating device.

The fastening means can be of different types. It is e.g. possible to use a solder or tin solder. The contacts and in particular also the connection bridge can be metallic or have metal parts or also ceramic parts. This enables soldering to take place in a particularly advantageous manner. In particular, the fastening means can comprise the combination of contacts with a solder. It is also possible to use a conductive adhesive, which dissolves or at least softens at a specific temperature.

As a result of the material composition of such a solder, tin solder or conductive adhesive it is possible to adjust its softening point. Thus, it is possible with a predetermined association of the fastening of the connection bridge on the contacts with the heating device or heat generation for there to be a softening of the solder and therefore a dissolving of the connection bridge at a given heating device temperature.

In an advantageous development of the invention, the connection bridge can comprise or have a metal part. The connection bridge is insulated to the outside between the connections with the contacts. Such an insulation should be heat-resistant. It is e.g. possible to use ceramic and glass coatings. With the exception of the connection bridge areas directly associated with the contacts, such coatings can cover the entire surface thereof. It is also possible to have a ceramic connection bridge or to produce the same with ceramic parts, so that it can itself be insulating.

A movement as a result of gravity can be a substantially vertically downwardly directed drop of the connection bridge. In a development of the invention, on releasing the fastening means at the contacts, the connection bridge has a tilting moment with respect to at least one contact. In particularly preferred manner there is a tilting moment relative to both contacts, so that on releasing the connection the connection bridge more rapidly and strongly is detached through said tilting moment. Thus, it even more rapidly interrupts the electrical connection and therefore the power supply. This is particularly advantageous in the case of a fastening or fixing with solder. In the case of a straight, through connection bridge it can occur that as a result of normal adhesion of the liquid or softened solder retains the connection bridge. A tilting of the connection bridge reliably separates the connection.

It can be advantageous for this purpose that the centre of gravity of the connection bridge is outside the connection line between the two contacts and as a result a tilting moment is built up. Advantageously the centre of gravity is in a horizontal direction outside and laterally alongside such a connection line. A possible shape for the connection bridge is a single or multiple twisted U-shape. With such a U-shape where fastening occurs at the two free ends, advantageously the aforementioned tilting moment can be produced.

A heating device for combining with an aforementioned fuse mechanism can have a support and a heating element. When the heating device is correctly used, the fuse mechanism can be positioned in such a way that the fastening means and/or the connection bridge are in heat conducting connection with the heating device. In particular, such a heat conducting connection should exist with the heating element.

For this purpose the fuse mechanism can be fixed to the support, preferably at a minimum distance therefrom. This provides a readily handleable component and a good heat conduction is obtained. Finally, temperatures at which preferred fastening means such as e.g. solders are heated, can be looked upon as critical for many heating devices.

As stated hereinbefore the fuse mechanism and in particular with the connection bridge, considered in the gravity direction, can be positioned below the heating device or heating element.

Moreover, considered in the gravity direction, the connection bridge can be positioned lower than or below the contacts. The contacts can in particular be flat and run substantially in a horizontal plane. In particular, the contact surface can be in a horizontal plane. It is also possible for the connection bridge to pass essentially in a horizontal plane.

The heating device can be constructed in such a way that the heating element is placed on a flat support of the heating device. Contacts for the heating element can be located on the bottom of the heating device. The term bottom relates to the subsequent installation position of the heating device. The heating element can be located on the top of the support and through-connections are possible. Advantageously the heating element is placed on the bottom. This is frequently the case, e.g. with water heaters, as stated hereinbefore.

The heating element can be insulated to the outside. It is also possible for the heating element and connection bridge to crossover or overlap and for this purpose an insulation should be positioned between them. The insulation is advantageously flat and the surface area should be at least as large as that of the connection bridge or the projection of the connection bridge onto the heating element. The insulation is advantageously applied in fixed manner to the heating element, e.g. as one of the aforementioned ceramic or glass coatings.

It is also possible to apply the heating element to the support in coating form using a coating process. A particularly preferred possibility is a thick film on an insulating support. The insulation can be brought about by a glass or ceramic surface.

According to a further development of the invention, the connections to the contacts are in the form of a resistor, e.g. as resistance tracks. Thus, during normal heating device operation there can be a preheating of the fastening at the contacts. Thus, such a fuse mechanism reacts more rapidly to overheating.

In similar manner it is possible to construct the connection bridge as a resistor. It can advantageously have a specific temperature coefficient of the resistor in such a way that it also ensures a preheating of the fastening.

These and further features can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subtitles in no way restricts the general validity of the statements made thereunder.

BRIEF DESCRIPTION OF THE DRAWINGS

Embodiments of the invention are described hereinafter relative to the diagrammatic drawings, wherein show.

DETAILED DESCRIPTION OF THE EMBODIMENTS

Figure 1:
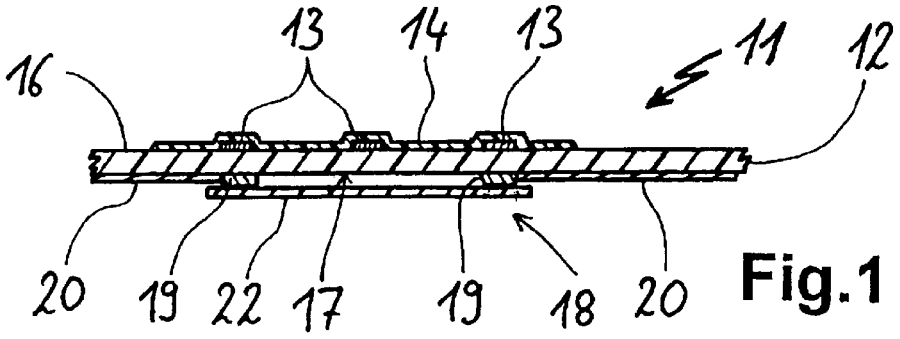
FIG. 1A section through a construction of a heating device according to the invention with a fuse mechanism according to the invention.

FIG. 1 shows in section a construction of a heating device 11 according to the invention. Like the other drawings, FIG. 1 is to be understood diagrammatically and serves to illustrate the various constructions based on the inventive principle.

On its top 16, a ceramic support 12 has several heating conductors 13. The heating conductors 13 can run in random tracks, as is known per se from the prior art. They can e.g. be applied using thick film technology. The heating conductors 13 and an area of the top 16 of the ceramic support 12 surrounding the same is provided with an insulation 14, which can e.g. be a glass coating or the like.

The upward insulation 14 of the heating conductors 13 offers the advantage of ensuring an electrical insulation. For example when used in a heating device 11 in a water heater or similar device, which can come into direct contact with foods or other media, the insulation 14 can shield the heating conductors 13.

A fuse 18, in this case a thermal fuse according to the invention, is fitted to a bottom 17 of the ceramic support 12. The fuse 18 has two spaced solder contacts 19, which are applied to the bottom 17. The solder contacts 19 have contact leads 20. Electrical conduction via contact lead 20 is to be fuse protected by means of fuse 18 and in serious cases interrupted.

For this purpose a connection bridge 22 is soldered with solder to the solder contacts 19. It links the contact leads 20. In a very simple construction the connection bridge 22 is made from conductive, particularly adequately solderable metal.

If the heating device 11 or ceramic support 12 become too hot, e.g. as a result of an excessive power consumption of the heating conductors 13 or e.g. a running dry of a water heater with inadequate heat dissipation, the solder contacts 19 are also heated. In the manner shown in FIG. 1, for this purpose they can be located directly facing a heating conductor 13 or only separated by the ceramic support 12.

The heating of the solder contacts 19 beyond a certain amount brings about a softening of the solder with which the connection bridge 22 is fastened. When the solder is softened, the connection bridge 22 can drop downwards through the action of gravity, i.e. away from the solder contacts 19. If the contact leads 20 are supplying power for the heating conductors 13, the latter are separated from the power supply. This corresponds to the basic principle of a thermal fuse with interruption.

For this purpose the heating device 11 is installed roughly as shown in FIG. 1. This means that the connection bridge 22 must be able to drop downwards away from the solder contacts 19, i.e. following the force of gravity. This does not fundamentally mean that it must be positioned below the heating conductors 13, because it can also be located laterally thereof. All that is important is that on softening of the solder connection of the connection bridge 22 at the solder contacts 19, the connection bridge is released.

Figure 2:
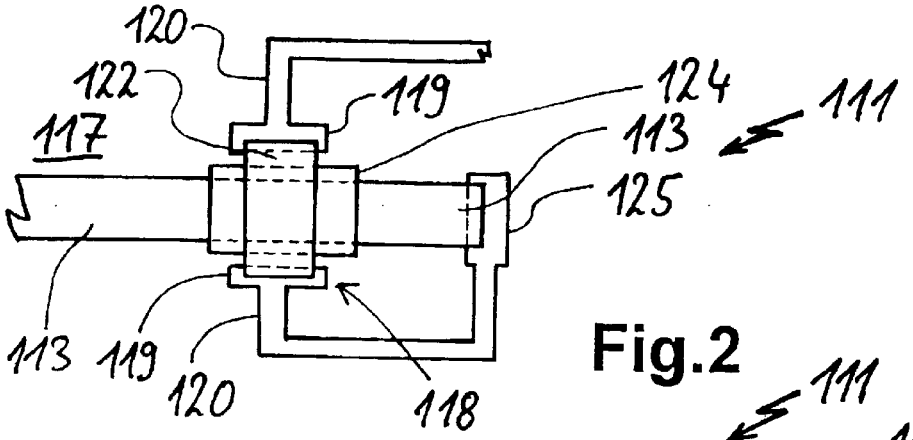
FIG. 2A plan view of an alternative construction of a heating device and fuse mechanism.

FIG. 2 shows a further construction according to the invention with a heating device 111. The latter can also be positioned on a bottom 117 of an insulating support. The representation of FIG. 2 is a plan view, e.g. from below.

An elongated heating conductor 113 is provided, which is connected at its right-hand end by a pad 125 to a contact lead 120. The lower contact lead 120 issues into a solder contact 119. Another solder contact 119 in the form of a pad is located on the other side of the heating conductor 113. It is in turn connected to a contact lead 120, which e.g. leads to a power supply.

A connection bridge 122 is positioned between the solder contacts 119. It is advantageously soldered to the solder contacts 119 in the manner described hereinbefore. Alternatively bonding or adhesion would be possible.

The solder preferably has a precisely defined melting point. This melting point or a softening resulting therefrom in conjunction with the weight of the connection bridge or its necessary cohesion in the fitted state, gives the release temperature of fuse 18 serving as a thermal fuse.

The heating conductor 113 can be supplied with electric power by means of the connection bridge 122, which is once again electrically conductive and is e.g. made from metal or has a metal core. As the connection bridge 122 crosses the heating conductor 113, an insulating layer 124 is provided between them and can e.g. be in glass or ceramic form.

In one construction of a fuse 118, the solder contacts 119 and therefore the solder are heated by the heating conductors 113. However, in particular heating takes place to the connection bridge 122, which crosses the heating conductors 113. The heating thereof also contributes to the heating and possible softening of the solder at solder contacts 119, which speeds up this process.

In place of an insulating layer 124 it is also possible to use a connection bridge 122, which is itself electrically insulating at least in the area where it bridges the heating conductor 113.

Figure 3:
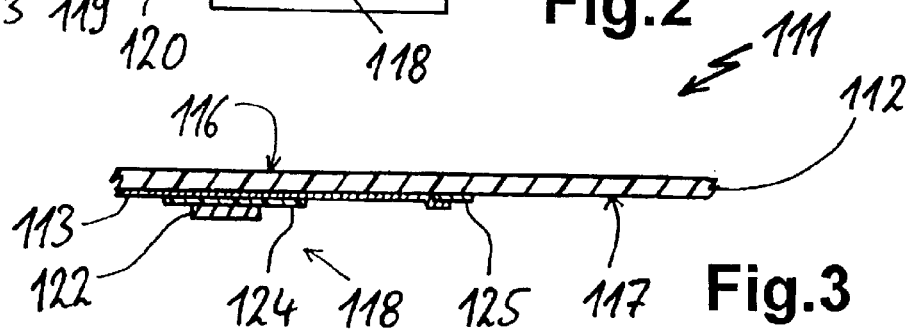
FIG. 3A section through the construction of FIG. 2.

It is also apparent from the sectional representation of FIG. 3 along heating conductor 113, how close the connection bridge 122 is to the heating conductors 113, whilst being separated by the insulating layer 124.

Fundamentally, according to the invention, the connection bridge can be constituted by a simple metal piece. It is also possible to choose an electrically conductive material with a precisely defined or desired conductivity. The consequence of this is that through the current flow for the power supply of the heating conductor via the connection bridge, the latter is preheated to a given temperature, which also roughly prevails at the solder contacts. Thus, it is possible to bring about an even faster release of the fuse in the case of preheated solder and a more rapid achieving of the softening point.

Figure 4:
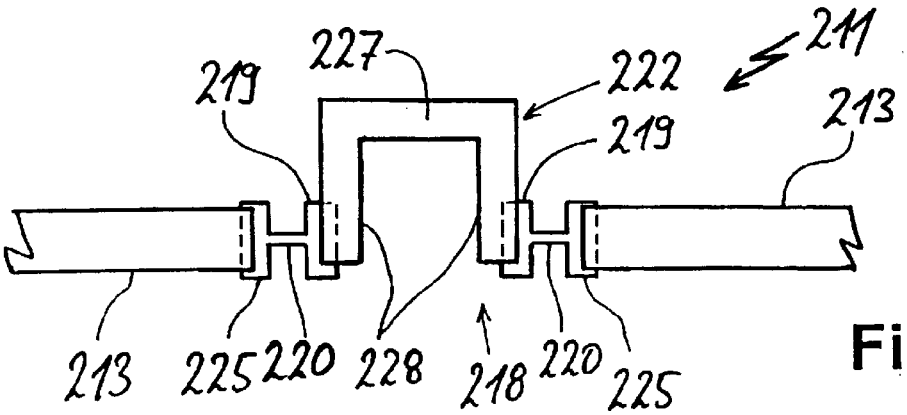
FIG. 4A further construction of a heating device and fuse mechanism in plan view.

FIG. 4 shows a third construction according to the invention of a heating device 211 with a fuse 218. Here heating conductors 213 are provided. Whereas in the constructions according to FIGS. 1 to 3, the connection bridge is provided in the lead to the heating conductor, in this construction the fuse or the connection to the bridge can be in the course of the heating conductor itself. This would also be possible with simple modifications in the case of the constructions according to FIGS. 1 to 3.

The ends of the heating conductors 213 are connected to pads 225. By means of the contact lead 220 they are connected or constructed in one piece with solder contacts 219. A connection bridge 222 is fixed by solder to the solder contacts 219.

This specific construction of the connection bridge 222 is roughly turned-round U-shaped. Legs 228 emanate from a base 227. The ends of the legs 228, opposite to the base 227, are soldered to the solder contacts 219. If it is borne in mind that the device according to FIG. 4 is installed head first, i.e. with the bottom 217 downwards, the following advantages arise with such a construction of the connection bridge 222.

If the solder connecting the connection bridge 222 to the solder contacts 219 becomes soft, in principle it is released and although it does not necessarily become liquid, it is at least viscous. However, this does not automatically mean that the connection bridge drops by gravity. The adhesive power of the softened, liquid solder, much as in the case of a drop of water, can prevent this. A straight connection bridge 122, such as e.g. can be gathered from FIG. 2, will continue to adhere to the solder contacts 119 if it is not heavy enough. The liquid solder would in fact provide the electrical connection.

However, with the connection bridge 222 according to FIG. 4, when the solder softens at solder contacts 219, the weight of the base 227 so-to-speak levers off the connection bridge. Thus, a liquid-based adhesive power can be overcome, even in the case of lightweight connection bridges.

Alternatively to an e.g. U-shaped construction of the connection bridge, it is possible for it on one side to extend further over the line between the solder contacts. Thus, it is virtually a matter of the centre of gravity of the connection bridge being outside the connection line between the solder contacts.

As has already been stated, the aforementioned construction possibilities according to the invention and in particular the embodiments according to FIGS. 1 to 4, can be extensively varied. Such possibilities can relate to the support 12, the nature and shape of the heating conductors 13, the nature of the electrical inter-connection with the fuse 18, the solder contacts 19, the shape of the connection bridge 22 and the connection thereof to the solder contacts 19. It is also possible to use conductive adhesives, which also have the necessary softening characteristics at a given temperature. In view of what has been stated hereinbefore, such variants are obvious to anybody skilled in the art.

What is claimed is:

1. A thermal fuse mechanism for a heating device, with a support and a heating element, said heating element being provided with two contacts and an electrically conductive connection bridge connecting said heating device to a power supply, said connection bridge being mechanically fastened in electrically conductive manner to both said contacts by fastening means and said mechanical fastening of said fastening means is released above a certain melting temperature, said thermal fuse mechanism being positioned on said heating device in such a way that said fastening means are in heat conducting connection with said heating device, wherein said connection bridge by said mechanical fastening to said contacts by means of said fastening means is secured against moving away due to gravity, wherein said connection bridge is constructed in such a way that on releasing said fastening at said contacts, there is a tilting moment with respect to at least one of said contacts, wherein said connection bridge has a centre of gravity, which is located outside a connection line between said two contacts, and wherein the centre of gravity of said connection bridge is in a horizontal direction outside and laterally alongside said connection line between said two contacts.

2. Fuse mechanism according to claim 1, wherein said fastening means for fastening said connection bridge to said contacts are formed by solder.

3. Fuse mechanism according to claim 2, wherein as a result of a material composition of said solder its softening point is adjustable in such a way that with a predetermined association of said fastening with said heating device, a softening occurs at a given heating device temperature.

4. Fuse mechanism according to claim 2, wherein said connection bridge is partly metal, wherein said metal is insulated to the outside.

5. Fuse mechanism according to claim 1, wherein said tilting moment occurs with respect to both said contacts.

6. A fuse mechanism for a heating device having a support and a heating element, the heating element being provided with two contacts, and an electrically conductive connection bridge connecting the heating device to a power supply, the connection bridge being mechanically fastened in electrically conductive manner to both of the contacts by fastening means, the mechanical fastening of the fastening means being released above a certain melting temperature, wherein the connection bridge by the mechanical fastening to the contacts by means of the fastening means is secured against moving away due to gravity, wherein said thermal fuse mechanism is positionable on the heating device in such a way that the fastening means is in heat conducting connection with the heating device, and wherein said connection bridge is U-shaped.

7. Heating device having a support and a heating element, as well as a thermal fuse mechanism according to claim 1, wherein said fuse mechanism is positioned on said heating device in such a way that said fastening means are in heat conducting connection with said heating device.

8. Heating device according to claim 7, wherein said fastening means are in heat conducting connection with said heating element.

9. Heating device according to claim 7, wherein said fuse mechanism is fastened to said support.

10. Heating device according to claim 7, wherein, considered in the gravity force direction, said fuse mechanism is located below said heating device.

11. Heating device according to claim 7, wherein, considered in the gravity force direction, said connection bridge is located below said heating element.

12. Heating device according to claim 7, wherein, considered in the gravity force direction, said connection bridge is positioned below said contacts.

13. Heating device according to claim 12, wherein said contacts are flat and run substantially in a horizontal plane.

14. Heating device according to claim 13, wherein said connection bridge runs substantially in a horizontal plane.

15. Heating device according to claim 7, wherein said connections to said contacts are in the form of a resistor and in normal operation said resistor brings about a preheating of said fastening to said contracts.

16. A heating device comprising:

a thermal fuse mechanism;

a support;

a heating element having two contacts; and an electrically conductive connection bridge connecting the heating device to a power supply, wherein the connection bridge is mechanically fastened in an electrically conductive manner to both said contacts by fastening means, the mechanical fastening of the fastening means being released above a certain melting temperature, wherein the connection bridge by the mechanical fastening to said contacts by means of the fastening means is secured against moving away due to gravity, wherein the thermal fuse mechanism is positioned on the heating device in such a way that the fastening means are in heat conducting connection with the heating device, and wherein said heating element is placed on a flat support and has contacts on the side which, relative to the subsequent installation, constitutes the bottom.

17. Heating device according to claim 16, wherein said heating element is located on said bottom.

18. A heating device comprising:

a thermal fuse mechanism;

a support;

a heating element having two contacts; and an electrically conductive connection bridge connecting the heating device to a power supply, wherein the connection bridge is mechanically fastened in an electrically conductive manner to both said contacts by fastening means, the mechanical fastening of the fastening means being released above a certain melting temperature, wherein the connection bridge by the mechanical fastening to said contacts by means of the fastening means is secured against moving away due to gravity, wherein the thermal fuse mechanism is positioned on the heating device in such a way that the fastening means are in heat conducting connection with the heating device, and wherein said heating element is insulated, said heating element and connection bridge creossing one another with an interposed insulation.

19. Heating device according to claim 18, wherein said insulation is flat and is applied in fixed form to said heating element.

20. A heating device comprising:

a thermal fuse mechanism;

a support;

a heating element having two contacts; and an electrically conductive connection bridge connecting the heating device to a power supply, wherein the connection bridge is mechanically fastened in an electrically conductive manner to both said contacts by fastening means, the mechanical fastening of the fastening means being released above a certain melting temperature, wherein the connection bridge by the mechanical fastening to said contacts by means of the fastening means is secured against moving away due to gravity, wherein the thermal fuse mechanism is positioned on the heating device in such a way that the fastening means are in heat conducting connection with the heating device, and wherein said connection bridge is constructed as a resistor and has a specific temperature coefficient of said resistor as a function of the temperature.

* * * * *